United States Patent [19]

Keller

[11] 4,229,891

[45] Oct. 28, 1980

[54] PLACARD HOLDING DEVICE

[75] Inventor: Robert L. Keller, Neenah, Wis.

[73] Assignee: J. J. Keller & Associates, Inc., Neenah, Wis.

[21] Appl. No.: 968,116

[22] Filed: Dec. 11, 1978

[51] Int. Cl.[3] ..... G09F 3/18

[52] U.S. Cl. ..... 40/17; 40/590

[58] Field of Search ..... 40/10 R, 16, 17, 10 A, 40/590, 591

[56] References Cited

U.S. PATENT DOCUMENTS

| | | | |
|---|---|---|---|
| 269,681 | 12/1882 | King | 40/17 |
| 745,598 | 12/1903 | Goodwin | 40/17 |
| 947,026 | 1/1910 | Peterson | 40/17 |
| 1,583,740 | 5/1926 | Palmer | 40/17 |
| 3,235,990 | 2/1966 | Back | 40/152 |
| 3,486,263 | 12/1969 | Larsson | 40/152 |

*Primary Examiner*—Robert Peshock
*Assistant Examiner*—Wenceslao J. Contreras

[57] ABSTRACT

A placard holding device for displaying a placard upon a vertical planar surface comprises a back frame member adapted for mounting upon the vertical planar surface and a front frame member having a flat surface portion enclosing an open window area. The front frame member is secured by a fastening assembly upon the back frame member. The fastening assembly includes a spacer member which holds the flat surface portion outwardly spaced from the back member and forms a placard holding pocket between the flat surface portion and the back frame member which is partially peripherally bounded by the spacer member. The portion of the pocket not bounded by the spacer member defines an access slot. An integral closure mechanism is provided which is operative for movement between an open position permitting passage of the placard through the access slot and a closed position preventing such passage. The device further includes an integral locking mechanism for maintaining the closure mechanism in the closed position while permitting selective movement of the closure mechanism from the closed to the open position.

9 Claims, 10 Drawing Figures

10
14
16
18
19
20
21
22
24
26
27
28
29
30
32
42
44
46
48
50
56
60
62
64
66
68
74
76
78
80
82
84

6
24
40
48
64
74
68
60
66
16
50
72
44
70
62
76
14

60
48
40
74
64
72
74
24
16
38
14
70
76
80
78
44
80
76

48
40
74
70
60
64
72
74
24
16
38
44
14
76
80
78
80
76

6
60
48
64
74
24
16
38
40
14
76
80
72
70
80
76

PLACARD HOLDING DEVICE

BACKGROUND OF THE INVENTION

I. Field of the Invention

The invention relates to placard holding devices.

II. Description of the Prior Art

Placard holding devices are known and widely used. One use is for displaying placards required by the Department of Transportation to be mounted upon vehicles, such as trucks and railroad boxcars, to indicate, for example, the carrying of hazardous cargo such as chlorine, poisons, explosives, radioactive materials, and the like. An example of a placard holder for such use is disclosed in Appendix C, Federal Register, Vol. 41, No. 188 (Monday, Sept. 27, 1976).

Because these and other placard holding devices are often exposed to inclement weather and rough handling, it is desirable to securely enclose the placard in the device to protect it from accidental loss and damage, while at the same time provide for easy access to the display pocket for insertion and removal of the placard.

SUMMARY OF THE INVENTION

One of the objects of this invention is to provide a placard holding device which securely holds the placard in the device while protecting it from damage and accidental loss.

Another object of the invention is to provide a placard holding device which minimizes the chance of water damage to the placard during display.

Yet another object of the invention is to provide a placard holding device which permits facile insertion and removal of the placard into and out of the device.

Still another object of the invention is to provide a placard holding device of simple and lightweight, yet rugged, construction suited for rough handling and exposure to the elements.

To accomplish these and other objects, the invention provides a placard holding device for displaying a placard upon a vertical planar surface area and comprising a back frame member adapted to be mounted upon the vertical planar surface and a front frame member having a flat surface portion enclosing an open window area. The device includes fastening means for mounting the front frame member on the back frame member, which fastening means includes spacer means for holding the flat surface portion outwardly spaced from the back frame member. Because of this outwardly spaced relationship, an interior placard holding pocket is formed intermediate the back frame member and the flat surface portion. This pocket is partially peripherally enclosed by the spacer means and includes an access slot. The device further includes closure means adjacent to the access slot and operative for movement between an open position permitting passage of the placard through the access slot, and thus into and out of the pocket, and a closed position blocking the passage. Locking means is provided for maintaining the closure means in the closed position, effectively sealing the placard inside the pocket, while permitting selective movement of the closure means to the open position to allow insertion and removal of the placard from the pocket.

In one embodiment, the device includes drain means spaced from the access slot for permitting fluid, such as rain water, to drain from the pocket when the device is mounted upon the vertical planar surface.

In the preferred embodiment, the fastening means, spacer means, closure means, locking means, and drain means all comprise a cooperation of integral structural elements juxtaposed on the front and back frame members. Specifically, the back frame member includes a plurality of adjoining back frame peripheral edges, and the flat surface portion includes a plurality of adjoining front frame peripheral edges enclosing the open window area, with the number of the front frame edges corresponding with the number of the back frame edges. In this embodiment, the spacer means includes an upstanding lip integral with the back frame member and extending perpendicularly along and inwardly of all but one of the back frame edges, with the one back frame edge comprising a rear smooth edge. Correspondingly, a groove is integral with the front frame member and extends along all but one of the front frame peripheral edges, the one front frame edge comprising a front smooth edge. The groove is symmetrically disposed for coextensive engagement with the upstanding lip when the front frame member is mounted on the back frame member, and the access slot is thereby formed intermediate the front and rear smooth edges.

In the preferred embodiment, the fastening means includes an aligned pair of fastening shoulders rising upwardly from and integral with the back frame member in proximity to the rear smooth edge. Each shoulder is located intermediate the respective upstanding lip and the respective back frame peripheral edge and includes a hooked-end portion projecting toward the upstanding lip and overhanging a portion of the back frame member, thereby defining a channel or slot therebetween. Correspondingly, a pair of fastening tabs extends laterally from and integral with the front frame member in proximity to the front smooth edge. The fastening tabs are adapted for sliding engagement in the slots when the front frame member is mounted upon the back frame member. The fastening means further includes bonding means for cohesively joining, for example, by sonic welding, the upstanding lip and groove in such engagement when the fastening tabs and slots are slidably engaged, to thereby securely join the front frame member and back frame member together.

Also in the preferred embodiment, the closure means includes a locking arm integral with and extending from the front smooth edge, the locking arm being generally resilient and having a normal coplanar position, an upwardly raised position, and a downwardly depressed position, all of which positions are relative to the plane of the flat surface portion. A closely spaced and parallel pair of upstanding ridges is located on the rear smooth edge and arranged for engagement by the locking arm when the blocking arm is displaced from the normal position to the downwardly depressed position. The combination of the locking arm and the pair of upstanding ridges blocks movement of the placard into and out of the placard holding pocket.

In this embodiment, the ridges include upper interior facing surfaces and lower interior facing surfaces. The locking means includes oppositely spaced notches in the lower interior facing surfaces and a pair of locking tabs oppositely spaced upon and extending laterally of the locking arm. The ridges are resiliently movable between a normal position and an outwardly deformed position. When the ridges are in their normal position and the locking arm is in its normal position, the locking tabs abut against the upper interior facing surfaces of the ridges; and when the locking arm is in the normal in its downwardly depressed position, the ridges are received and held by the notches. In the outwardly deformed position, the ridges yield to the passage of the locking arm between the normal position and the downwardly depressed position in response to movement of the locking tabs along the upper interior facing surfaces.

By virtue of the construction of the preferred embodiment, when the locking arm is disposed in the normal position, passage of the placard through the access slot is obstructed by the abutment of the locking tabs against the ridges. The locking arm must be lifted to its upwardly raised position, holding the locking tabs out of abutting relationship with the ridges, to permit unobstructed passage of the placard into and out of the pocket. Subsequent movement of the locking arm to the downwardly depressed position snap-fits the locking tabs within the notches, thereby maintaining the locking arm in the downwardly depressed position and effectively sealing the access slot closed. A placard positioned in the pocket is locked therein.

In the preferred embodiment, the drain means includes an interruption in the upstanding lip in an area oppositely spaced from the rear smooth edge and a notch in the front frame peripheral edge oppositely spaced from the front smooth edge, i.e. in the lowermost area of the device. The notch is adapted to align with the interruption when the front frame member is mounted on the back frame member. Accordingly, a gravity drain port is defined when the device is mounted on the vertical planar surface.

Other object and advantages will be pointed out in, or be apparent from, the specification and claims, as will obvious modifications of the embodiment shown in the drawings.

BRIEF DESCRIPTION OF THE DRAWINGS

FIG. 9 is an exploded and partially fragmentary front elevation view of a portion of the placard holding device of FIG. 1, showing the construction of the gravity drain port.

DESCRIPTION OF THE PREFERRED EMBODIMENT

Figure 1:
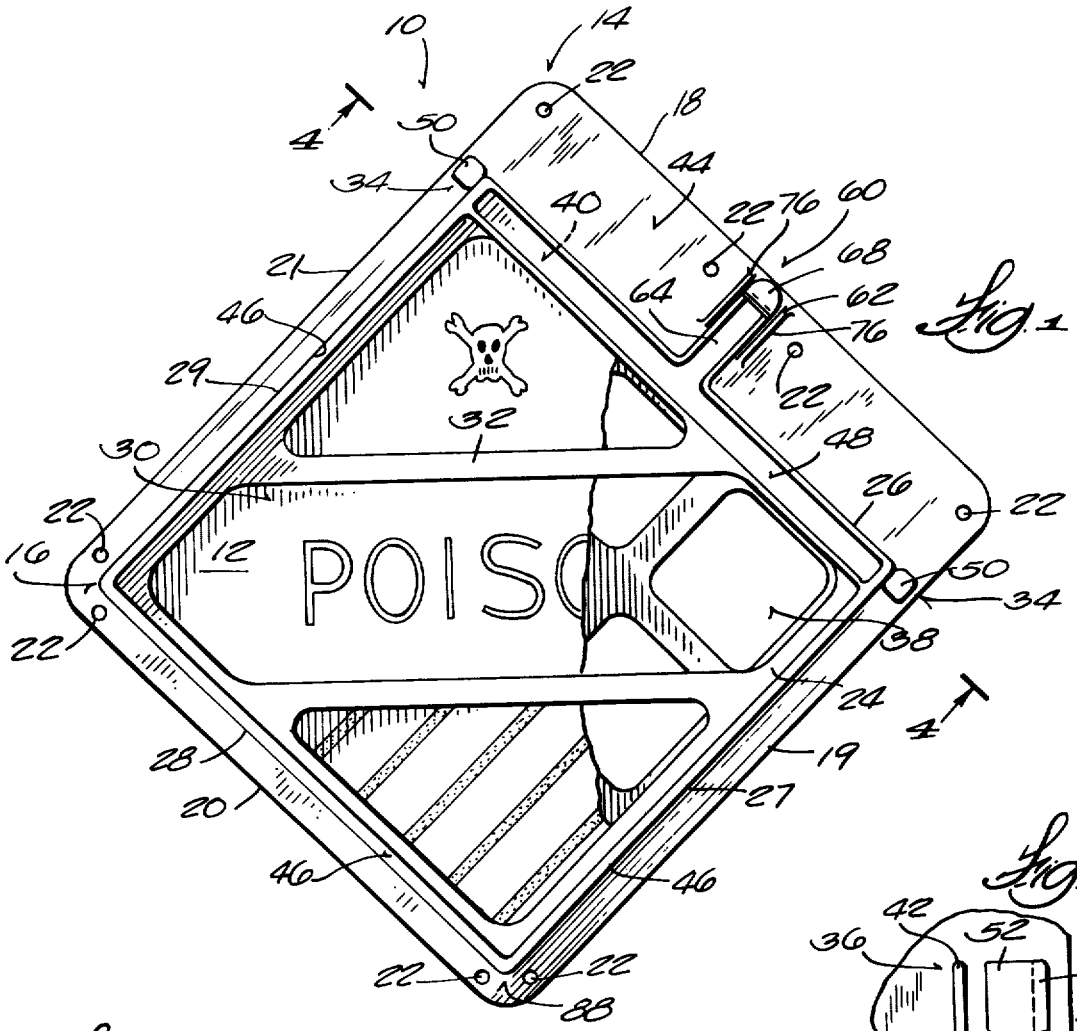
FIG. 1 is a front elevation view of a placard holding device which embodies features of the invention.
Figure 2:
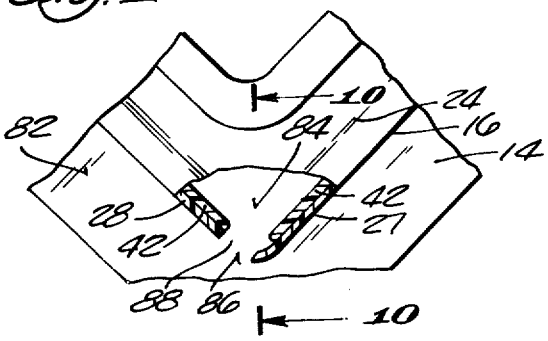
FIG. 2 is an expanded front view of the placard holding device of FIG. 1, showing its two piece construction.

A placard holding device 10 for displaying a placard 12 upon a wall or other vertical planar surface is shown in FIG. 1. While the device 10 is applicable for use in various environments, in the illustrated embodiment it is assumed that the device 10 will be mounted on a vertical planar surface which is exposed to the weather and to rough treatment, such as on the sidewall of a truck or railroad boxcar. As shown in FIG. 2, the device 10 is of two-piece construction having a back frame member 14 and a front frame member 16. Because exposure to weather and rough handling is anticipated, both frame members 14 and 16 are constructed of a lightweight, yet rugged, material, such as injection molded plastic.

The device 10 can assume various shapes and sizes which are for the most part dictated by the shape and size of the placard 12 to be displayed. In the illustrated embodiment (as best seen in FIG. 2), the back frame member 14 includes four adjoining back frame peripheral edges 18, 19, 20, and 21 which define a generally square frame body. A plurality of mounting apertures 22 are generally spaced along the back frame peripheral edges 18, 19, 20, and 21, through which screws, such as sheet metal screws (not shown), may pass for affixing the back frame member 14 upon the wall or other desired display surface.

The front frame member 16 corresponds in shape with the back frame member 14, but has external dimensions which are less than the external dimensions of the back frame member 14. The front frame member 16 incorporates a ribbed, reinforced construction for additional strength and includes a flat surface portion 24 having four adjoining front frame peripheral edges 26, 27, 28, and 29 which enclose a generally open window area 30.

The open window area 30 can be variously shaped, depending upon the configuration of the placard's message. In the illustrated embodiment, the window 30 is partitioned off by rib members 32 into three distinct viewing sections. As can be seen in FIG. 1, this configuration is specifically designed to correspond with a three-tier placement of information on a hazardous material placard 12 which separately displays a symbol, a word, and a color.

Figure 3:
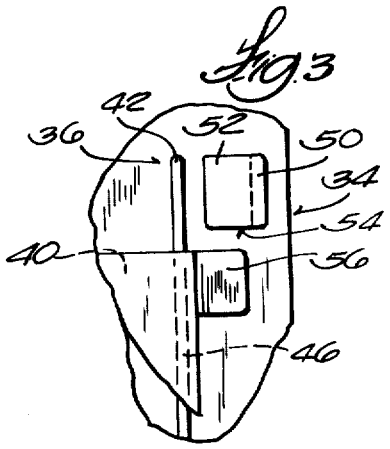
FIG. 3 is an exploded front elevation view of a portion of the placard holding device of FIGS. 1 and 2, showing part of the fastening assembly.
Figure 4:
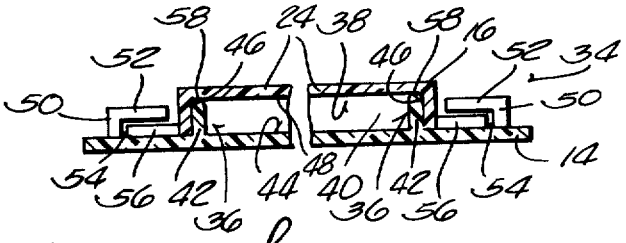
FIG. 4 is a partial sectional view of the placard holding device taken generally along line 4—4 on FIG. 1.

As best seen in FIGS. 1, 3 and 4, the device 10 includes fastening means 34 for mounting the front frame member 16 on the back frame member 14. The fastening means 34 includes spacer means 36 so that, when the front frame member 16 is mounted upon the back frame member 14, the flat surface portion 24, and thus the open window area 30, is held outwardly spaced from the back frame member 14 (as best seen in FIG. 4). Spacer means 36 extends around three sides of the back frame member 14 i.e. all sides except that in the area of line 4—4 in FIG. 1. By virtue of this spaced relationship between the two frame members 14 and 16, an interior placard holding pocket 38 is formed which is located intermediate the back frame member 14 and the flat surface portion 24 and is partially peripherally enclosed by the spacer means 36. The portion of the pocket 38 not bounded by the spacer means 36 defines an access slot 40 through which the placard 12 may be inserted into or removed from the pocket 38.

Referring to the specific embodiment illustrated, and appreciating that other structural features may be used to accomplish the same results, the spacer means 36 includes an upstanding lip 42 which is integral with the back frame member 14 and extends perpendicularly along and inwardly of three of the four back frame peripheral edges 19, 29 and 21 (as best shown in FIG. 1). The upstanding lip 42 thus forms, in plain view, a generally U-shaped structure rising from the back frame member 14, and the one edge 18 along which the lip 42 does not extend comprises a rear smooth edge 44.

As best shown in FIG. 4, the spacer means 36 further includes a groove 46 which is integral with the front frame member 16 and extends, as does the upstanding lip 42, along all but one of the front frame edges 27, 28 and 29. The one edge 26 upon which the groove 46 does not extend comprises a front smooth edge 48. As can best be seen in FIGS. 3 and 4, the groove 46 is symmetrically disposed on the front frame member 16 so that, when the front frame member 16 is mounted on the back frame member 14, the groove 46 and the lip 42 are coextensively engaged.

As should now be apparent, and as is best shown in FIGS. 1 and 4, when the front frame member 16 is mounted on the back frame member 14, the placard holding pocket 38 is formed intermediate the back frame member 14 and the flat surface portion 24 and is partially peripherally bounded by the lip 42. The access slot 40 is located intermediate the front and rear smooth edges 44 and 48.

Referring next to the fastening means 34, which securely mounts the front frame member 16 upon the back frame member 14 and seals the peripheral edges 27, 28 and 29 of the pocket 38, an aligned pair of integral fastening shoulders 50 rises upwardly from the back frame member 14, each of which pair 50 is located intermediate the respective terminal edge of the lip 42 and the respective back frame peripheral edge 19 or 21. As is best seen in FIG. 4, each shoulder includes a bent or hooked-end portion 52 which projects toward the upstanding lip 42 and overhangs a portion of the back frame member 14, thereby defining a channel or slot 54.

As shown in FIGS. 1, 3 and 4, the fastening means 34 further includes a pair of integral fastening tabs 56 extending laterally from the front frame member 16 in proximity to the front smooth edge 48. As can best be seen in FIG. 4, the tabs 56 are adapted for sliding engagement in the channels 54 when the front frame member 16 is mounted on the back frame member 14 with the groove 46 and upstanding lip 42 in co-extensive engagement. By virtue of the engagement of the tabs 56 in the channels 54 the outermost edges of the access slot 40 are thus secured.

To complete the connection between the front and back frame members 14 and 16 along the perimeter edges 27, 28 and 29 of the pocket 38, the upstanding lip 42 and groove 46 are cohesively joined together at area 58 along their coextensive engagement when the fastening tabs 56 are slidably engaged in the channels 54. This cohesive joining is accomplished by sonic welding or gluing. The assembly of the two frame members 14 and 16 into a single placard holding device 10 is thereby completed.

In the exposed and rugged environment in which the device 10 is suited for use, it is desirable to securely hold the placard 12 within the pocket 38 and protect it from accidental loss or damage. For this purpose, the device 10 includes closure means 60 for selectively opening and closing the access slot 40 and locking means 62 for selectively locking the access slot 40 in the closed position. As with the heretofore described fastening means 34 and spacer means 36, the closure and locking means 60 and 62 comprise a cooperation of structural elements juxtaposed on the front and back frame members 14 and 16.

Figure 5:
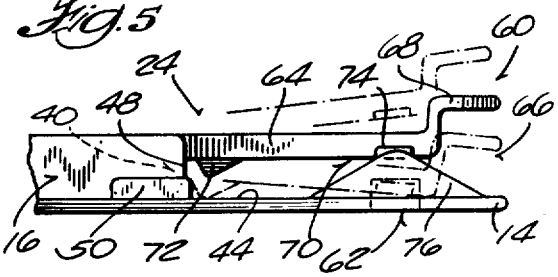
FIG. 5 is a partial side view of the placard holding device of FIG. 1 showing the closure and locking assemblies.

Referring first to the closure means 60, as best seen in FIG. 5, a locking arm 64 is integral with and extends from the front smooth edge 48. The locking arm 64 is made of a resilient material, such as the plastic from which the front frame member 16 is preferably molded, and is thus flexibly movable between a normal coplanar position relative to the flat surface portion 24 of the front frame member 16 (shown in solid lines in FIG. 5), an upwardly raised position relative to the flat surface portion 24 (as shown in phantom lines in FIG. 5), and a downwardly depressed position relative to the flat surface portion 24 (also as shown in phantom lines in FIG. 5). The locking arm 64 includes an upwardly raised outer lip 68 at its outer end portion 66. Upward or downward pressure upon the outer lip 68 will move the locking arm 64, respectively, upwardly or downwardly from its normal position.

A spaced pair of ridges 76 rises upwardly from the rear smooth edge 44. As shown in FIGS. 5–8, and as will be described in detail later herein, the ridges 76 combine with the locking arm 64 to form the closure means 60 to block movement of the placard 12 into and out of the placard holding pocket 30.

Referring next to the locking means 62, which cooperates with the closure means 60 just described, a pair of laterally extending locking tabs 74 is integral with the outer end portion 66 of the locking arm 64. Generally, the locking tabs 74 are adapted to be snap-fitted between the latching ridges 76 in response to manual downward pressure upon the outer lip 68, which moves the locking arm 64 into its downwardly depressed position.

Figure 6:
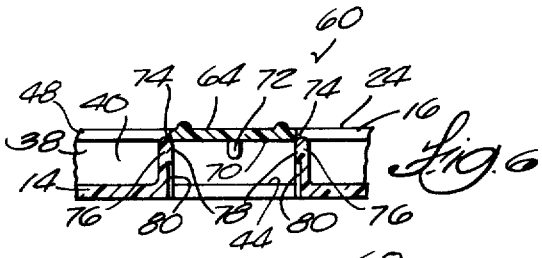
FIG. 6 is a partial sectional view of the placard holding device taken generally along line 6—6 of FIG. 5 and showing the locking arm in its normal coplanar position.
Figure 7:
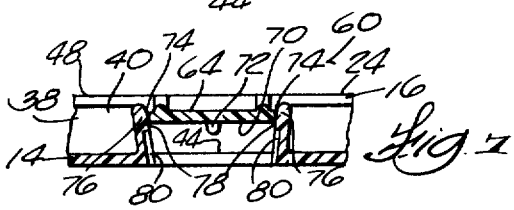
FIG. 7 is a partial sectional view similar to FIG. 6, except that the locking arm is being moved downwardly from its normal coplanar position.
Figure 8:
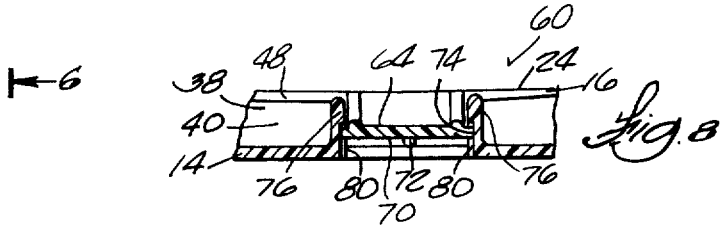
FIG. 8 is a partial sectional view similar to FIG. 7, except that the locking arm is shown locked in its downwardly depressed position.

Referring to the operational sequence shown in FIGS. 6, 7 and 8, the ridges 76 are constructed of a relatively resilient material, such as the plastic from which the rear frame member 14 is preferably molded, and are laterally deformable within certain predetermined limits between a normally upstanding position (shown in FIGS. 6 and 8) and an outwardly deformed position (shown in FIG. 7).

The ridges 76 have interior facing surfaces which comprise an upper smooth surface 78 and a lower notched, or cut-out, surface 80. When the ridges 76 are in the normally upstanding position, the distance between the upper smooth surfaces 78 is slightly less than the combined lateral width of the locking arm 64 and locking tab 74 assembly (as shown in FIG. 6), while the distance between the lower cut-out surfaces 80 is slightly greater than the combined lateral width of the locking arm 64 and tab 74 assembly (as shown in FIG. 8).

By virtue of the differences in lateral dimensions just described, when the locking arm 64 is in the normal position, the locking tabs 74 rest against the uppermost extension of the ridges 76 (as shown in solid lines in FIG. 5 and in FIG. 6), and passage of the placard 12 through the open access slot 40 is obstructed by this abutment. To permit passage of the placard 12 through the access slot 40, it is necessary to apply upward manual pressure against the outer lip 68, which moves the locking arm 64 to the upwardly raised position, thereby separating the tabs 74 from the ridges 76 (as shown in phantom lines in FIG. 5). A placard 12 can now pass between the under body 70 of the locking arm 64 and the uppermost extension of the ridges 76, through access slot 40, and into the pocket 38 for display. The removal of upward manual pressure upon the outer lip 68 allows the locking arm 64 to resiliently spring back to its normal position.

Downward manual pressure applied to the outer lip 68 will move the locking arm 64 from its normal position toward the downwardly depressed position. By virtue of the differences between the lateral dimensions of the upper smooth surfaces 78 and the combined width of the locking arm 64 and locking tab 74 assembly, coupled with the resiliency of the ridges 76 themselves, the locking tabs 74 jointly bear against the upper smooth surface 78 as downward manual pressure is applied (see FIG. 7) and thereby move the resilient ridges 76 from the normal upstanding position to the outwardly deformed position. The ridges 76 thus yield to the passage of the tabs 76 along the upper smooth surface 78.

However, when the locking tabs 74 reach the lower cut-out surface 80, the locking tabs 74 encounter a dimension greater than their lateral width, which frees the tabs 74 from contact with the interior facing surfaces and permits the ridges 76 to resiliently spring from the outwardly deformed position back to the normal upstanding position (as shown in FIG. 8). Due to the inherent vesiliency of arm 64, it is biased toward its normal position but is prevented from doing so by tabs 74. A nub or protrusion 72 on the underbody portion 70 of the locking arm 64 facilitates this essentially levered inherent bias of the locking arm 64. As should now be apparent, a snap-fit engagement has occurred.

As best seen in FIG. 8 and in phantom lines in FIG. 5, when the locking tabs 74 are in this snap-fit engagement, the locking arm 64 is maintained in the downwardly depressed position and passage through the access slot 40 is blocked. As should now be apparent, the placard 12 carried by the pocket 38 secured therein, and the chance of accidental loss of the placard 12 out of the pocket 38 is thereby substantially reduced.

When it is desired to remove the placard 12 from the pocket 38, upward pressure is applied against the outer lip 68 to free the locking tabs 74 from the cut-out surface 80 and to allow the tabs 74 to once again bear against the upper smooth surface 78. When the locking tabs 74 are eventually moved free of engagement of the upper smooth surface 78, thereby permitting the locking arm 74 to return to its normal position, the ridges 76 resiliently spring back to the normal upstanding position. Further upward manual pressure upon the outer lip 68 will move the locking arm 74 to the upwardly raised position and permit passage of the placard 12 out of the pocket 38 through the open access slot 40.

As shown in FIG. 1, the placard holding device 10 as heretofore described is adapted for mounting on an upstanding surface such that the square frame body is tilted and defines a diamond. At this angle, the placard 12 is displayed through the three-tier display window 30 to show, respectively, a symbol, a word, and a color.

Figure 10:
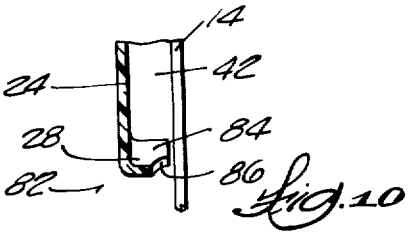
FIG. 10 is a sectional view taken generally along line 10—10 of FIG. 9.
Figure 2:
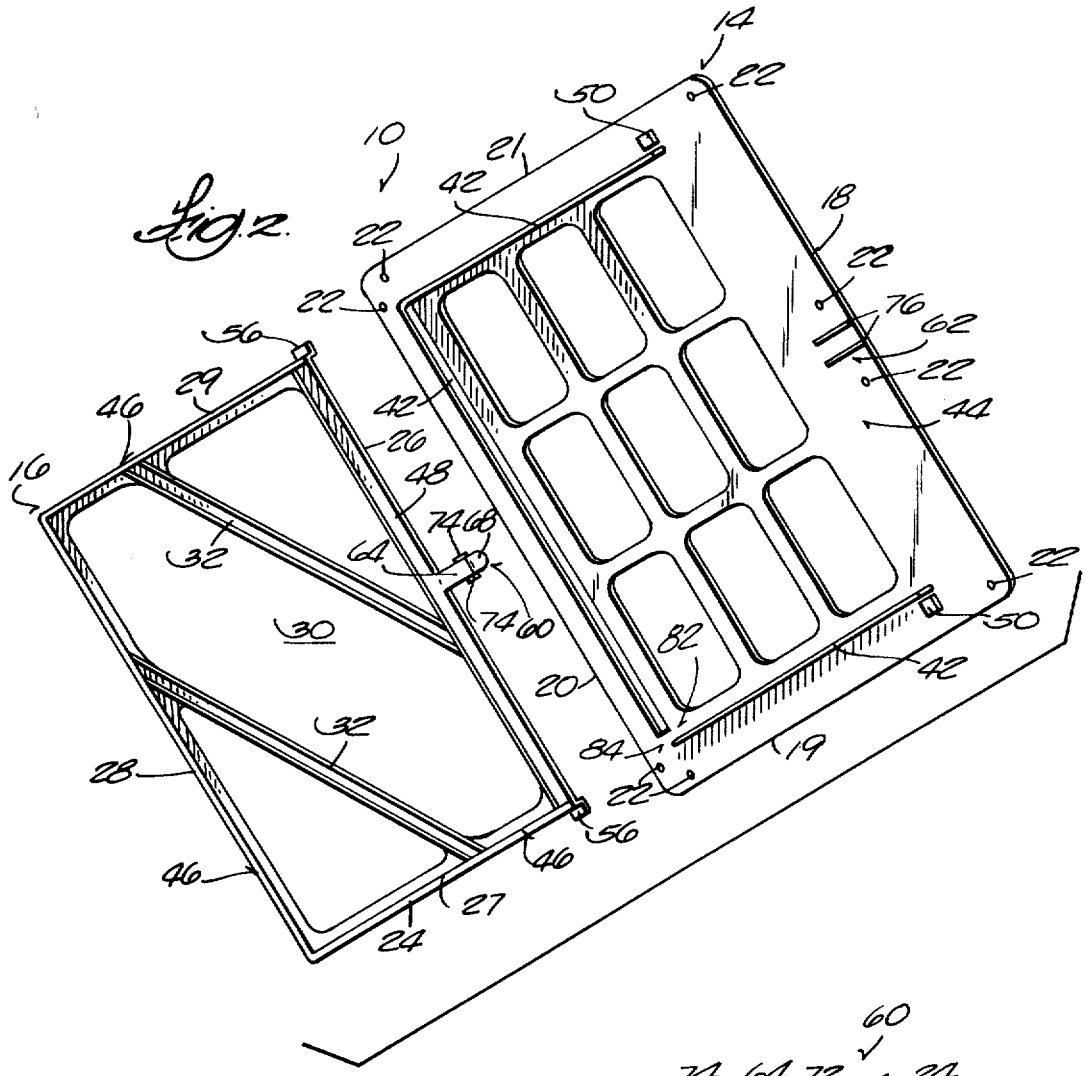

Referring now to FIGS. 9 and 10, the device 10 includes draining means 82 for permitting a fluid, such as rain water, to drain from the interior pocket 38 when the device 10 is mounted in the position above-described. As shown in FIGS. 2 and 3, the draining means 82 includes an interruption 84 in the upstanding lip 42 in the bottom corner, and a notch 86 formed in the peripheral edge 28 of the front frame member 16 so positioned to align with the placement of the interruption 84 to cooperatively form a gravity drain port 88. As should be apparent, such a drain port 88 is placed at the lowermost point along the perimeter of the pocket 28 and can be varied dependent upon how the device 10 is mounted upon the upstanding surface.

Although but one embodiment of the present invention has been illustrated and described, it will be apparent to those skilled in the art that various changes and modifications may be made therein without departing from the spirit of the invention or from the scope of the appended claims.

I claim:

1. A placard holding device for displaying a placard upon a vertical planar surface comprising:

a back frame member adapted to be mounted upon the vertical planar surface and including a plurality of adjoining back frame peripheral edges;

a front frame member having a flat surface portion enclosing an open window area, said flat surface portion including a plurality of adjoining front frame peripheral edges enclosing said open window area, with the number of said front frame edges corresponding with the number of said back frame edges;

fastening means for mounting said front frame member on said back frame member and including an upstanding lip integral with said back frame member and extending perpendicularly along all but one of said back frame edges, said one back frame edge comprising a rear smooth edge, a groove integral with said front frame member and extending along all but one of said front frame edges, said one front frame edge comprising a front smooth edge, said groove symmetrically disposed for coextensive engagement with said upstanding lip when said front frame member is mounted on said back frame member;

an interior placard holding pocket formed intermediate said back frame member and said flat surface portion when said front frame member is mounted on said back frame member, said placard holding pocket peripherally enclosed by said upstanding lip along all but said rear smooth edge and including an access slot formed intermediate said front and rear smooth edges;

a locking arm integral with and extending from said front smooth edge, said locking arm being generally resilient and having a normal generally coplanar position relative to said flat surface portion for permitting passage of the placard through said access slot and movable from said normal position toward a displaced position; obstructing means on said back frame member located on said rear smooth edge and arranged for engagement by said locking arm when said locking arm has been displaced from said normal position and together with said displaced locking arm blocking movement of the placard into and out of said placard holding pocket; and locking means for maintaining said engagement between said displaced locking arm and said obstructing means while permitting selective movement of said locking arm between said displaced position and said normal position.

2. A placard holding device according to claim 1 wherein said locking means includes:

a pair of locking tabs oppositely spaced upon and extending laterally of said locking arm; and latching means integral with said obstructing means and operative for engaging said locking tabs when said locking arm is displaced from said normal position, thereby holding said locking arm in said displaced position, while permitting disengagement of said locking tabs when said locking arm is moved from said displaced position to return to said normal position.

3. A placard holding device according to claim 2 wherein said obstructing means includes:

a closely-spaced pair of parallel upstanding ridges having upper interior facing surfaces and lower interior facing surfaces, wherein said latching means includes oppositely spaced notches in said lower interior facing surfaces; and whereby said ridges are resiliently movable between a normal position, in which said locking tabs abut said upper interior facing surfaces when said locking arm is in said normal position and in which said locking tabs are received by said notches when said locking arm is in said displaced position, and an outwardly deformed position yielding to the passage of said locking arm between said normal position and said displaced position, said ridges being movable from said normal position to said outwardly deformed position in response to movement of said locking tabs along said upper interior facing surfaces.

4. A placard holding device according to claim 3 wherein when said locking arm is in said normal position, passage of the placard through said access slot is obstructed by said abutment of said locking tabs with said ridges; and said locking arms is further movable from said normal position to an upwardly raised position relative to said flat surface portion so that said locking tabs are free of said abutment with said ridges and said access slot is open for insertion and removal of the placard.

5. A placard holding device for displaying a placard upon a vertical planar surface comprising:

a back frame member adapted to be mounted upon the vertical planar surface and including a plurality of adjoining back frame peripheral edges;

a front frame member having a flat surface portion enclosing an open window area, said flat surface portion including a plurality of adjoining front frame peripheral edges enclosing said open window area, with the number of said front frame edges corresponding with the number of said back frame edges;

an upstanding lip integral with said back frame member and extending perpendicularly along all but one of said back frame edges, said one back frame edge comprising a rear smooth edge, said upstanding lip being spaced inwardly of the other ones of said back frame peripheral edges;

a groove integral with said front frame member and extending along all but one of said front frame edges, said front frame edge comprising a front smooth edge, said groove symmetrically disposed for co-extensive engagement with said upstanding lip when said front frame member is mounted on said back frame member;

an aligned pair of fastening shoulders rising upwardly from and integral with said back frame member in proximity to said rear smooth edge, each of said pair located intermediate said respective upstanding lip and said respective back frame peripheral edge, each of said pair including a hooked-end projecting toward said upstanding lip and overhanging a portion of said back frame member, thereby defining a slot between said hooked-end portion and said back frame member;

a pair of fastening tabs extending laterally from and integral with said front frame member in proximity to said front smooth edge, each of said tabs adapted for sliding engagement in respective one of said slots when said front frame member is mounted on said back frame member;

bonding means for cohesively joining said upstanding lip and said groove in engagement when said fastening tabs and said slots are slidably engaged;

an interior placard holding pocket formed intermediate said back frame member and said flat surface portion when said front frame member is mounted on said back frame member, said placard holding pocket peripherally enclosed by said upstanding lip along all but said rear smooth edge and including an access slot formed intermediate said front and rear smooth edges;

closure means adjacent to said access slot and operative for movement between an open position permitting passage of the placard through said access slot and a closed position blocking said passage; and locking means for maintaining said closure means in said closed position while permitting selective movement of said closure means between said closed and said open position.

6. A placard holding device for displaying a placard upon a vertical planar surface comprising:

a back frame member having a plurality of adjoining back frame peripheral edges and adapted to be mounted upon the vertical planar surface;

a front frame member having a flat surface portion including a plurality of adjoining front frame peripheral edges enclosing an open window area, with the number of said front frame edges corresponding with the number of said back frame edges;

an upstanding lip integral with said back frame member and extending perpendicularly along and inwardly of all but one of said back frame edges, said one back frame edge comprising a rear smooth edge;

a groove integral with said front frame member and extending along all but one of said front frame edges, said one front frame edge comprising a front smooth edge, said groove symmetrically disposed for coextensive engagement with said upstanding lip when said front frame member is mounted upon said back frame member;

an aligned pair of fastening shoulders rising upwardly from and integral with said back frame member in proximity to said rear smooth edge, each of said pair located intermediate said respective upstanding lip and said respective back frame peripheral edge, each of said pair including a hooked-end portion projecting toward said upstanding lip and overhanging a portion of said back frame member, thereby defining a slot between said hooked-end portion and said back frame member;

a pair of fastening tabs extending laterally from and integral with said front frame member in proximity to said front smooth edge, each of said tabs adapted for sliding engagement in respective one of said slots when said front frame member is mounted on said back frame member with said upstanding lip and said groove in said engagement;

bonding means for cohesively joining said upstanding lip and said groove in engagement when said fastening tabs and said slots are slidably engaged;

an interior placard holding pocket formed intermediate said back frame member and said flat surface portion when said fastening tabs and said slots are slidably engaged and said upstanding lip and said groove are engaged by said bonding means, said placard holding pocket partially peripherally enclosed by said upstanding lip and including an access slot formed intermediate said front and rear smooth edges;

a locking arm integral with and extending from said front smooth edge, said locking arm being generally resilient and having a normal coplanar position, an upwardly raised position, and a downwardly depressed position, all of said positions relative to said flat surface portion;

a pair of locking tabs oppositely spaced upon and extending laterally of said locking arm;

a closely spaced pair of parallel upstanding ridges integral with said rear smooth edge and having upper interior facing surfaces and lower interior facing surfaces including oppositely spaced notches, said ridges being resiliently movable between a normal position, in which said locking tabs abut said upper interior facing surfaces when said locking arm is in said normal position and in which said locking tabs are received by said notches when said locking arm is in said downwardly depressed position, and an outwardly deformed position yielding to the passage of said locking arm between said normal and said downwardly depressed position, said ridges being movable from said normal position to said outwardly deformed position in response to movement of said locking tabs along said upper interior facing surfaces;

when said locking arm is in said normal position, passage of the placard through said access slot is obstructed by said abutment of said locking tabs with said ridges and wherein movement of said locking arm from said normal position to said upwardly raised position holds said locking tabs free of said abutment and permits the passage; and when said locking arm is maintained by said notches in said downwardly depressed position, the combination of said locking arm and said ridges blocks movement of the placard into and out of said placard holding pocket.

7. A placard holding device according to claim 6 further including:

an interruption in said upstanding lip oppositely spaced from said rear smooth edge; and a notch in said front frame peripheral edge oppositely spaced from said front smooth edge, said notch adapted to align with said interruption when said upstanding lip and said groove are engaged by said bonding means, thereby forming a gravity drain port when said device is mounted on the vertical planar surface.

8. A placard holding device according to claim 7 wherein said device is constructed of plastic.

9. A placard holding device according to claim 8 wherein said bonding means includes sonic welding.

* * * * *